US005889501A

United States Patent [19]

Sasaki et al.

[11] Patent Number: 5,889,501

[45] Date of Patent: Mar. 30, 1999

[54] PLASMA DISPLAY APPARATUS AND METHOD OF DRIVING THE SAME

[75] Inventors: Takashi Sasaki, Hiratsuka; Masaji Ishigaki, Yokohama; Norio Yatsuda, Chigasaki; Yuji Sano, Zushi; Hiroshi Ohtaka, Yokohama, all of Japan

[73] Assignee: Hitachi, Ltd., Tokyo, Japan

[21] Appl. No.: 651,328

[22] Filed: May 22, 1996

[30] Foreign Application Priority Data

May 26, 1995 [JP] Japan ..... 7-128502

[51] Int. Cl.[6] ..... G09G 3/28

[52] U.S. Cl. ..... 345/60; 345/55

[58] Field of Search ..... 345/60, 61, 62, 345/64, 55

[56] References Cited

FOREIGN PATENT DOCUMENTS 5-119738 5/1993 Japan .

*Primary Examiner*—Matthew Luu

*Attorney, Agent, or Firm*—Fay Sharpe Beall Fagan Minnich & McKee

[57] ABSTRACT

A plasma display apparatus is disclosed, in which a plurality of pixels are arranged in dot matrix, at least one first electrode specifies the addresses of the pixels, a set of electrodes including a second electrode and a third electrode are arranged in a plurality of pixels for generating a pixel display plasma, and a phosphor member arranged in a plurality of pixels for illuminating light due to the ultraviolet light generated from the pixel display plasma. In the process of driving the plasma display apparatus, the pixel display plasma is erased by applying a plurality of erase pulses with progressively shorter pulse durations and intervals alternately between selected two of the first, second and third electrodes.

10 Claims, 13 Drawing Sheets

PLASMA DISPLAY APPARATUS AND METHOD OF DRIVING THE SAME

BACKGROUND OF THE INVENTION

1. Field of the Invention

The present invention relates to a method of driving a dot-matrix AC plasma display panel of memory type used with the display unit for personal computers or work stations, wall-hung flat panel TV, advertisement display systems and the like.

2. Description of the Related Art

In conventional AC plasma display, as disclosed in JP-A-5-119738, for example, illumination display is performed by discharging between a plurality of joint-line X electrodes 16 and a plurality of disjoint-line Y1 to Yn electrodes 17 shown in FIG. 6. For erasing the charge by this method of driving an AC plasma display panel, as shown in FIG. 2, an erase pulse 54 of a waveform 51 applied to the disjoint-line Y electrodes is superposed on a sustaining pulse 53 of a waveform 50 applied to the joint-line X electrodes. As a result, two erase pulses 55, 56 are formed in a waveform 52 representing the relative potential difference between the X and Y electrodes.

Further, with a panel having a great number of pixels, this charge-erasing process is repeated a plurality of times to assure successful erasure of charge. In the process, the sequential discharge erasure for each line of the disjoint-line Y electrodes requires a sustaining pulse to be continually applied to the joint-line X electrodes until complete erasure of all the lines. The erasure process is also required to terminate with the sustaining pulse. Further, the erase pulse 54 has a different potential from the sustaining pulse 57.

SUMMARY OF THE INVENTION

The object of the present invention is to provide a method of driving a plasma display and a plasma display apparatus capable of simplifying the circuit configuration shortening the erasure time, and erasing the charge accurately.

In the conventional method described above in the present specification, a time as long as a plurality of sustaining pulse cycles is required to repeat a plurality of erasure processes. More specifically, in the case where the period of sustaining pulse is about 10 μsec, two or three iterations of the erasure process takes a time length of about 20 or 30 μsec. As a result, the time for illumination display is shortened, thereby reducing the luminance. Also, a circuit for applying a different potential is complicated. The present invention is intended to solve such problems and accurately erasing the charge.

According to the invention, in the case of separated address-display scheme, short erase pulses with progressively shorter pulse durations are applied a plurality of times alternately between two electrodes forming a space from which charge is to be erased. For the sequential address-display scheme, on the other hand, short erase pulses of progressively shorter pulse durations are applied a plurality of times alternately between an disjoint-line Y electrode and a joint-line X electrode in such a manner that even-numbered erase pulses applied to the joint-line X electrodes following the first erase pulse applied to the disjoint-line Y electrodes are located in the pulse duration of the sustaining pulse for the other disjoint-line Y electrodes not erased. In this way, the erasure process is completed during the pulse duration of the sustaining pulse for the other disjoint-line Y electrodes not to be erased.

According to the invention, accurate erasure is made possible within a short time by the configuration described above. The method of the invention will be explained with reference to the separated address-display scheme. In FIG. 1, a waveform 38 represents a voltage waveform of a sustaining pulse 39, a first short erase pulse 40 and a third short erase pulse 45 applied to a Yi electrode among disjoint-line Y2, Y4, . . . , Yn electrodes providing even-numbered line electrodes. A waveform 41 shows a voltage waveform of a sustaining pulse 42 and a second short erase pulse 44 applied to a joint X electrode providing an odd-numbered line electrode. A waveform 43, on the other hand, represents a relative potential difference between two electrodes to be discharged, i.e., a voltage waveform of the potential of an disjoint-line Yi electrode less the potential of a joint-line X electrode.

Accurate charge erasure is made possible by alternately applying short erase pulses with progressively shorter pulse durations between a joint-line X electrode and a disjoint-line Yi electrode.

With regard to the sequential address-display scheme shown in FIG. 12, on the other hand, a waveform 4 represents a voltage waveform of a sustaining pulse 11 applied to an disjoint-line Yi+2 electrode adjacent to a disjoint-line Yi electrode. A waveform 5 is a voltage waveform of the potential of an disjoint-line Yi+2 electrode less the potential of a joint-line X electrode.

During the erase period between a joint-line X electrode and a disjoint-line Yi electrode, the discharge is sustained by sustaining pulses 9 and 11 between the joint-line X electrode and the disjoint-line Yi+2 electrode. Upon application of the second short erase pulse 10 to the joint-line X electrode, the relative potential difference drops to an intermediate potential 12. This potential, however, is subsequently restored to a high potential 13, thereby sustaining the charge without erasure.

As described above, erasure is possible for each line within a short time, with the other lines being sustained in discharge mode.

According to this invention, accurate erasure can be accomplished within a time as short as several μsec which otherwise might take as long as several tens of μsec. In addition, a margin of illumination time is obtained, and an erroneous discharge can be prevented.

DESCRIPTION OF THE PREFERRED EMBODIMENTS

An embodiment of the invention is described below with reference to FIGS. 1 to 3 and FIG. 16.

Figure 3:
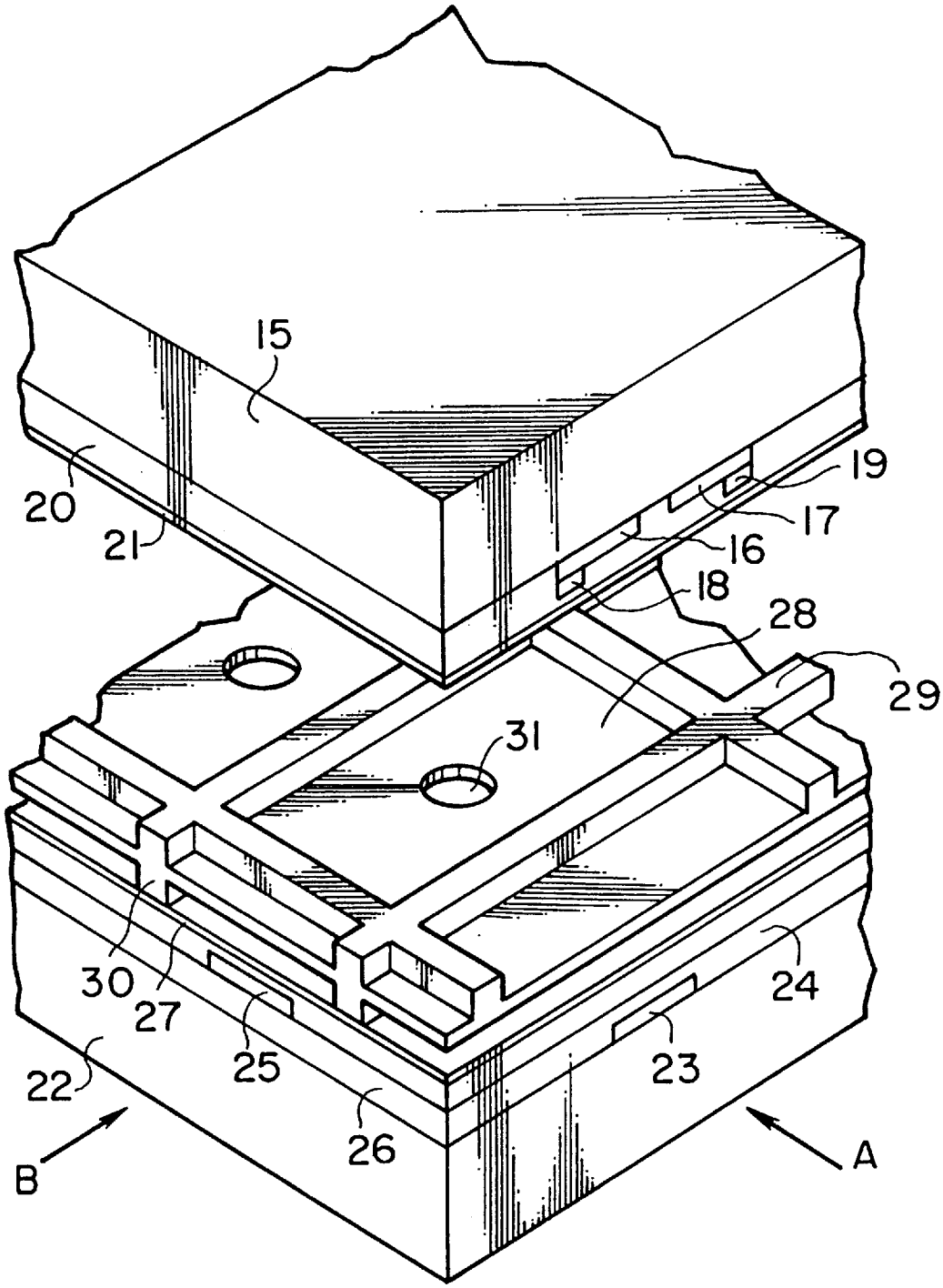
FIG. 3 is an exploded perspective view showing a part of the structure of a plasma display panel.

FIG. 3 is an exploded perspective view showing a part of a plasma display panel structure according to the present invention. A face plate 15 has on the lower surface thereof a transparent joint-line X electrode 16 and a transparent disjoint-line Y electrode 17. These electrodes have an X bus electrode 18 and a Y bus electrode 19 arranged thereon respectively. Further, a dielectric member 20 and a protective layer 21 of MgO or the like are laid on the lower surface of the electrodes.

A trigger T electrode 23 is arranged on the upper surface of a back plate 22 in parallel to the line electrodes and is covered with a dielectric member 24. Further, an address A electrode arranged in the direction perpendicular to the trigger T electrode 23 is covered by a dielectric member 26 and a protective layer 27 of such a material as MgO.

An intermediate-layer barrier rib (unit) 30 including a space barrier 28 for separating upper and lower discharge spaces and a plurality of cell barrier ribs 29 for separating display cells are held between the face plate 15 and the back plate 22. The phosphor illuminated by being excited by vacuum ultraviolet light rays generated during discharge is coated on the side of the intermediate-layer barrier rib unit 30 nearer to the face plate 15.

The barrier 28 has a plurality of apertures 31 for allowing charged particles to move between upper and lower discharge spaces. The discharge spaces are filled with a discharge gas such as a rare gas.

Figure 4:
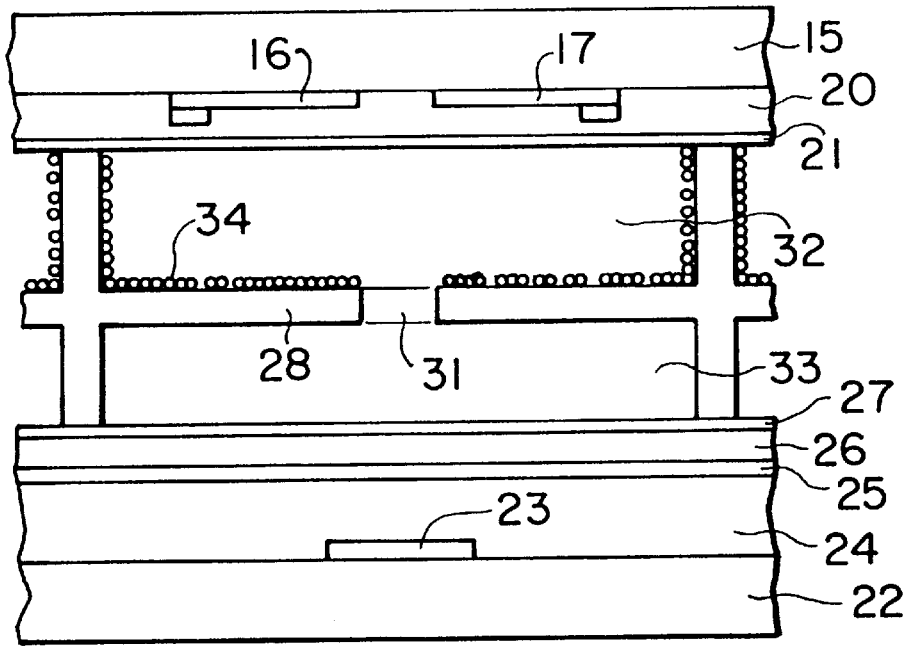
FIG. 4 is a sectional view of a plasma display panel.

FIG. 4 is a sectional view of the plasma display panel as viewed from the direction of arrow A in FIG. 3.

In FIG. 4, a trigger T electrode 23 is located between a joint-line X electrode 16 and an disjoint-line Y electrode 17. The barrier surface portions defining a main discharge space 32 are coated with phosphor 34.

Figure 5:
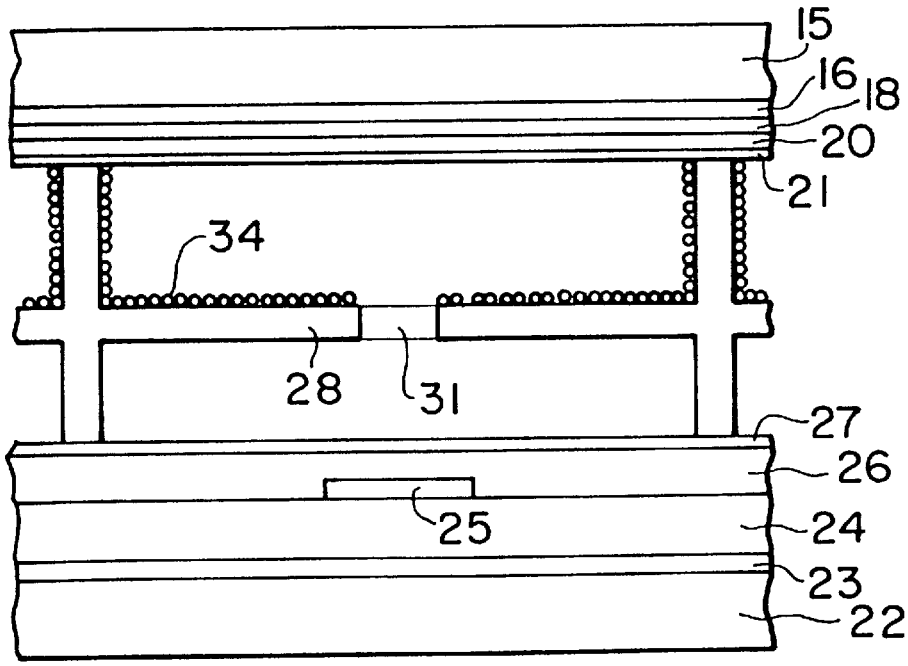
FIG. 5 is a sectional view of a plasma display panel.

FIG. 5 is sectional view of a plasma display panel as viewed from the direction of arrow B in FIG. 3.

In FIG. 5, the aperture 31 formed in the barrier 28 for partitioning the main discharge space 32 and an address discharge space 33 from each other is located over the address A electrode 25.

Figure 6:
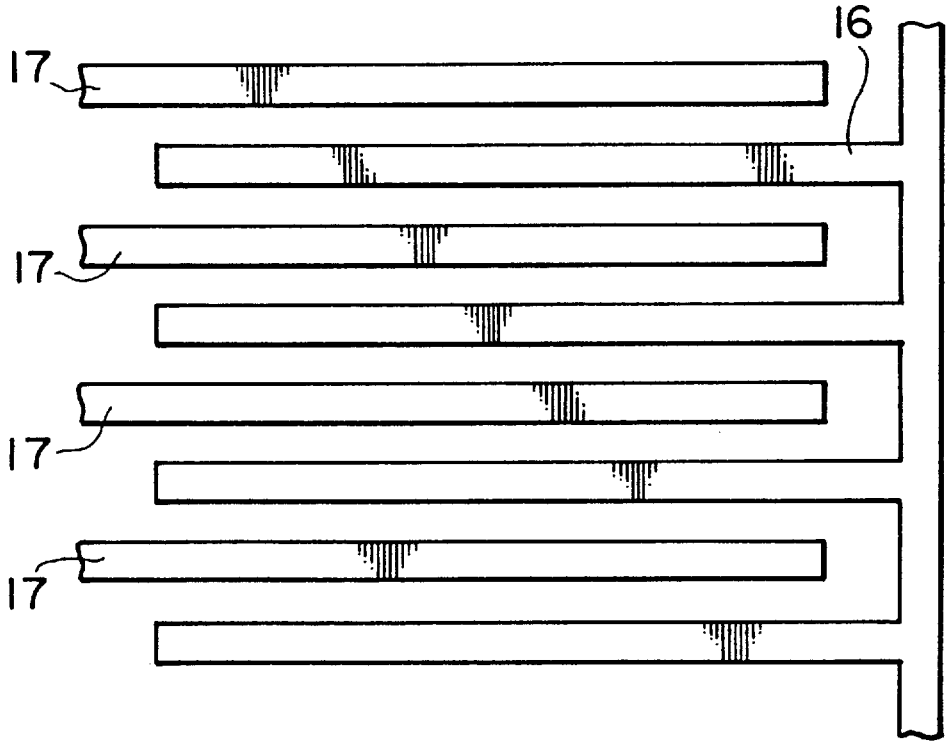
FIG. 6 is a plan view showing a part of a face plate.

FIG. 6 is a plan view showing a part of the face plate 15.

In FIG. 6, the joint-line X electrodes 16 are connected to each other at an end thereof unlike the disjoint-line Y electrodes 17.

Figure 7:
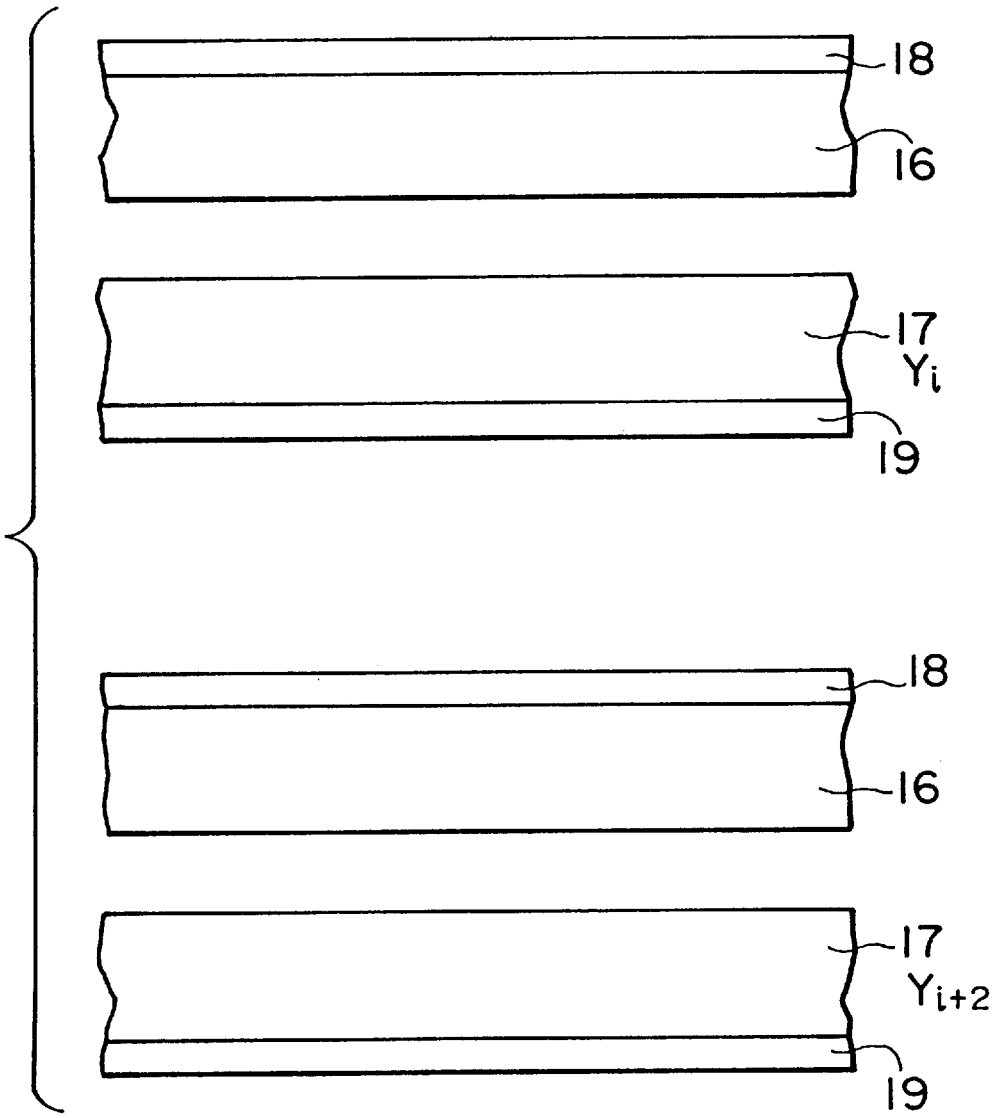
FIG. 7 is an enlarged plan view showing a part of a face plate.

FIG. 7 is a plan view showing a part of the face plate 15 in enlarged form.

In FIG. 7, a joint-line X electrode 16 is combined with an arbitrary disjoint-line Yi electrode 17 for performing main discharge of a cell. Also, another one of the joint-line X electrodes 16 is combined with a disjoint-line Yi+2 electrode 17 to accomplish main discharge of an adjacent cell.

Figure 8:
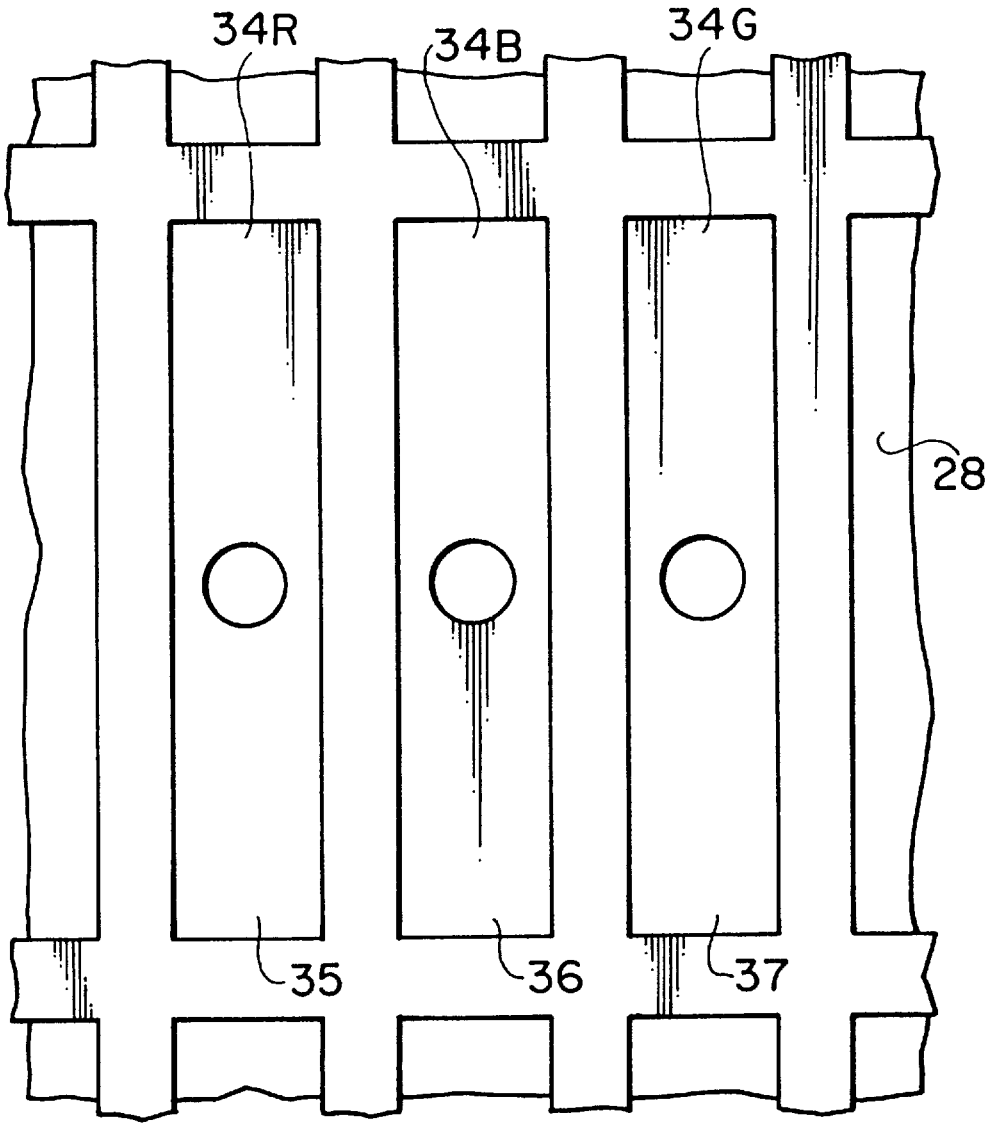
FIG. 8 is a plan view showing a part of a barrier unit for the intermediate layer.

FIG. 8 is a plan view showing a part of the intermediate-layer barrier rib unit 30.

In FIG. 8, three contiguous cells 35, 36, 37 are painted in different colors of phosphors 34R, 34B, 34G for illuminating red, blue and green lights respectively. The three cells constitute one pixel.

Figure 9:
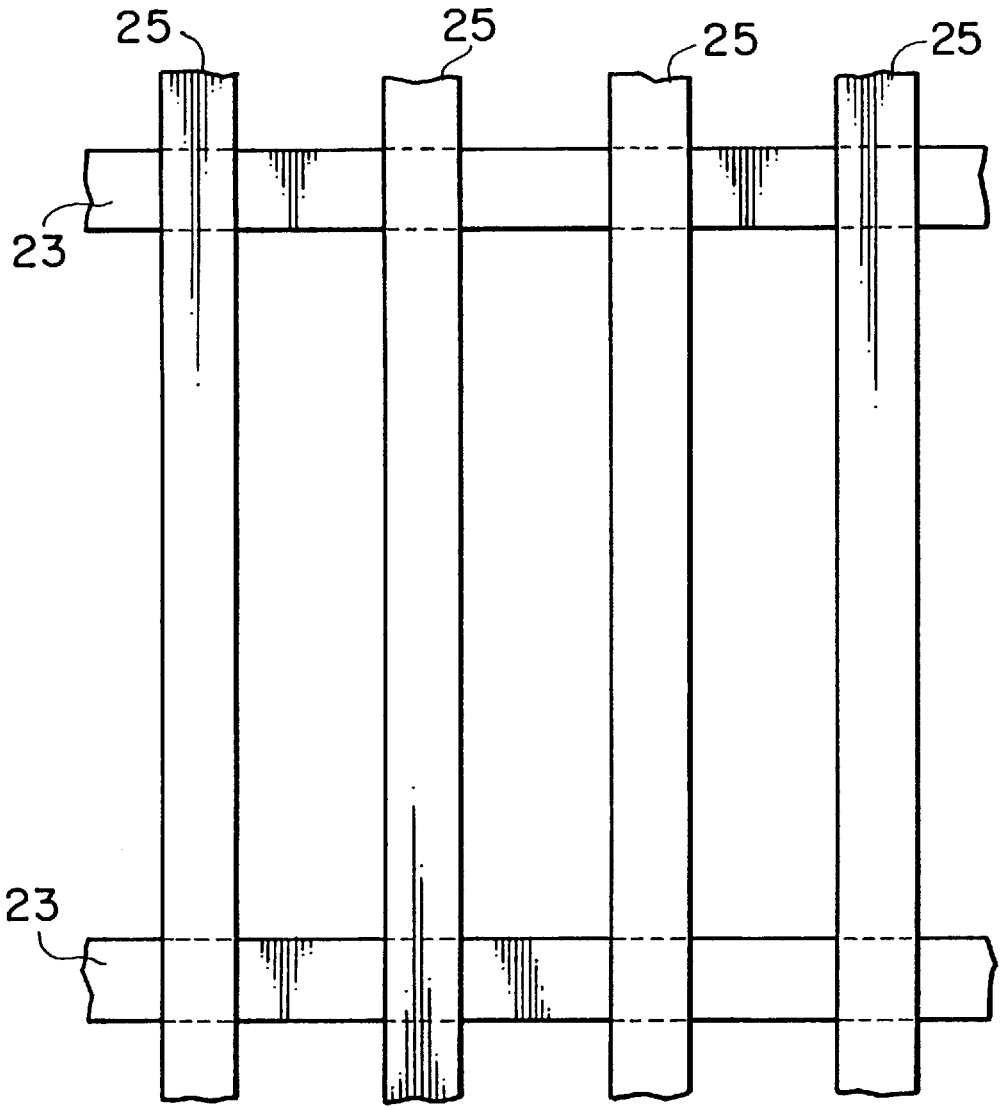
FIG. 9 is a plan view showing a part of a back plate.

FIG. 9 is a plan view showing a part of the back plate 22.

In FIG. 9, the trigger T electrodes 23 and the address A electrodes 25 are arranged to intersect at right angles to each other.

The face plate 15 and the back plate 22 hold and seal the intermediate-layer barrier rib unit 30 therebetween, and replacing atmosphere with a discharge gas, make up a plasma display panel.

Now, an explanation will be made about a scheme for specification (addressing) and display of the light-emitting cells of a plasma display.

Figure 15:
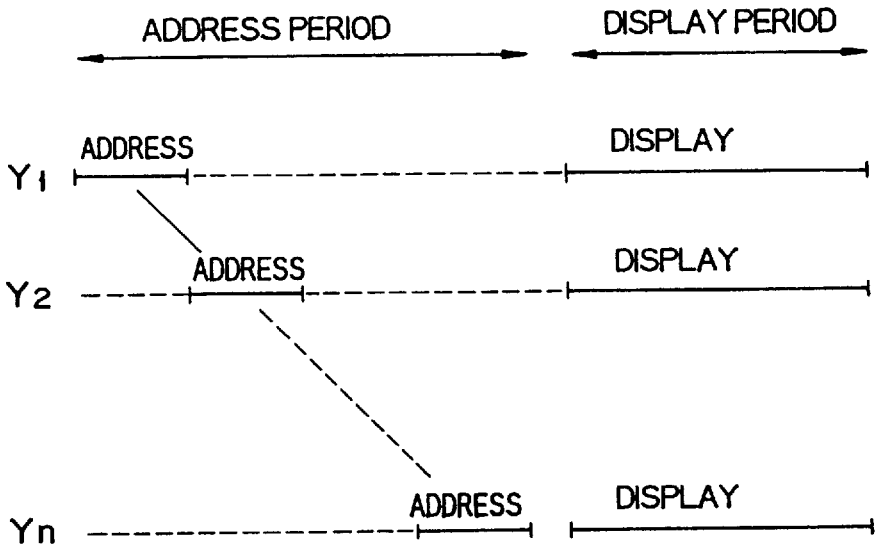
FIG. 15 is a diagram showing the separated address-display scheme.

FIG. 15 shows a separated address-display scheme for temporally separating the address period in which address is made for each line and the display period from each other.

Figure 16:
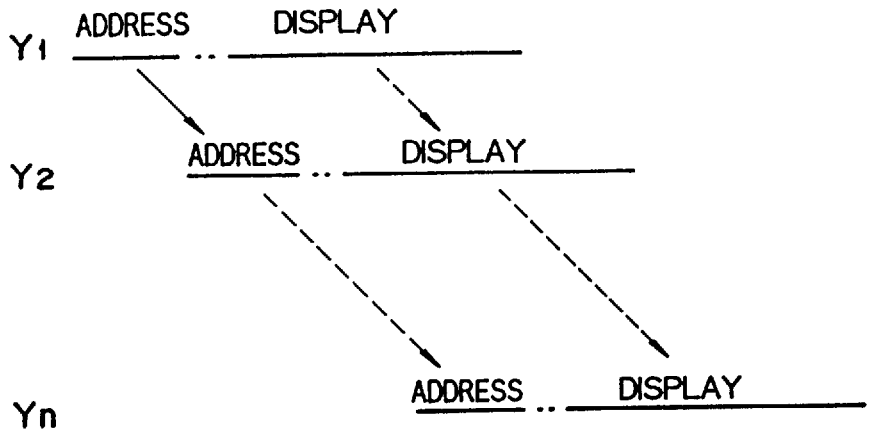
FIG. 16 is a diagram showing the sequential address-display scheme.
Figure 18:
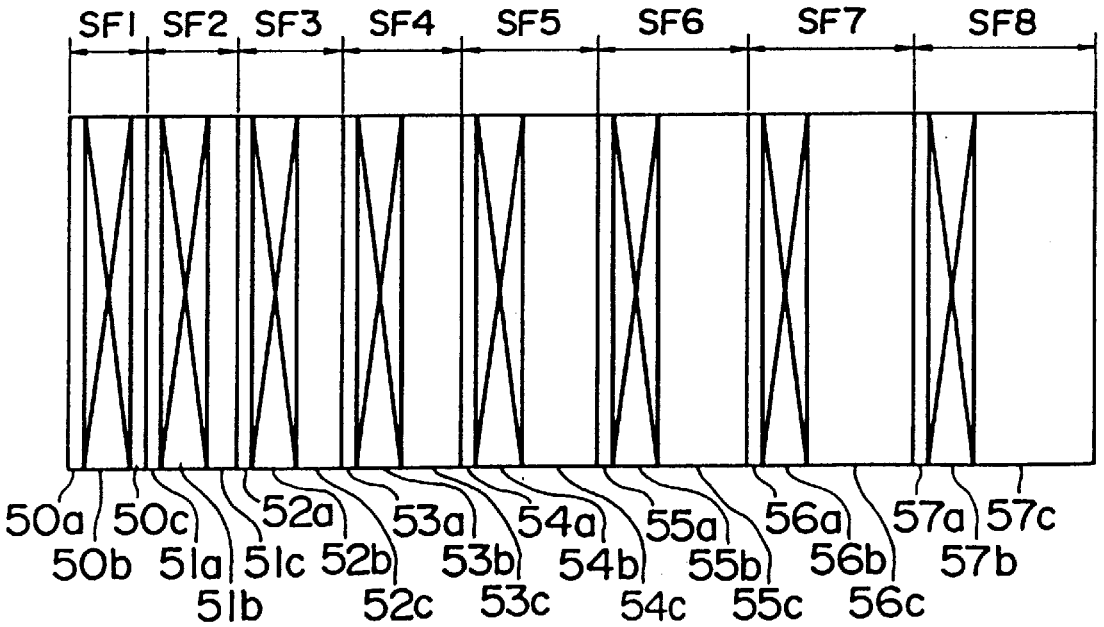
FIG. 18 is a diagram showing the configuration of a single screen in the separated address-display scheme.

FIG. 18 is a diagram showing the configuration of a field for the separated address-display scheme. A field includes a plurality of subfields, for example, eight subfields SF1, SF2, SF3, SF4, SF5, SF6, SF7, SF8 in the case under consideration. Each subfield is comprised of full write erasure periods 50*a* to 57*a*, address periods 50*b* to 57*b* and display periods 50*c* to 57*c*. FIG. 16 shows a sequential address-display scheme (line sequential scheme) for performing display following making address for each line. In this case, even after completion of display for a given line, display is continued for the next line.

Next, explanation will be made about the erasure process for a plasma display panel according to this invention.

Figure 10:
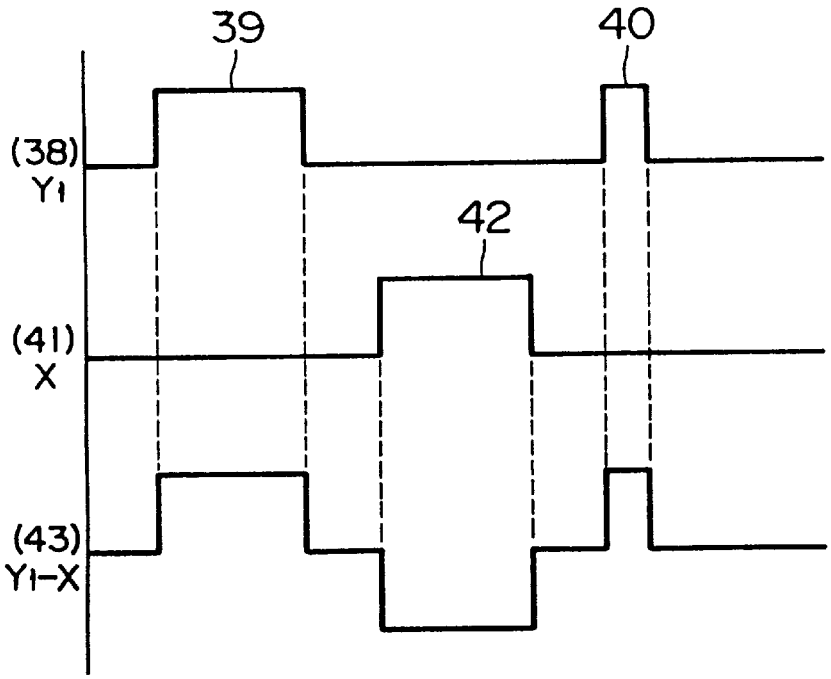
FIG. 10 is a diagram showing voltage waveforms representing the discharge-sustaining and erasing processes.

FIG. 10 shows voltage waveforms representing the discharge-sustaining and erasing processes between a disjoint-line Yi electrode and a joint-line X electrode according to the separated address-display scheme.

In FIG. 10, the waveform 38 represents a sustaining pulse 39 and a first short erase pulse 40 applied to the disjoint-line Yi electrode. The waveform 41 represents a sustaining pulse 42 applied to the joint-line X electrode. The waveform 43, on the other hand, is a voltage waveform indicates the relative potential difference between two electrodes, i.e., the potential of a disjoint-line Yi electrode less the potential of a joint-line X electrode.

After discharge is sustained by the sustaining pulses 39 and 42, the first short erase pulse 40 is applied to an electrode different from the one to which the last sustaining pulse 42 is applied thereby to erase the discharge. The first short erase pulse 40 has a duration of less than about 1.5 μsec. Such a short pulse cannot sustain a sufficient charge to maintain the discharge, resulting in the discharge being erased. In the case involving a multiplicity of cells, however, it sometimes happen that discharge cannot be sufficiently erased by only the first short erase pulse due to the discharge characteristics varied among the cells.

Figure 11:
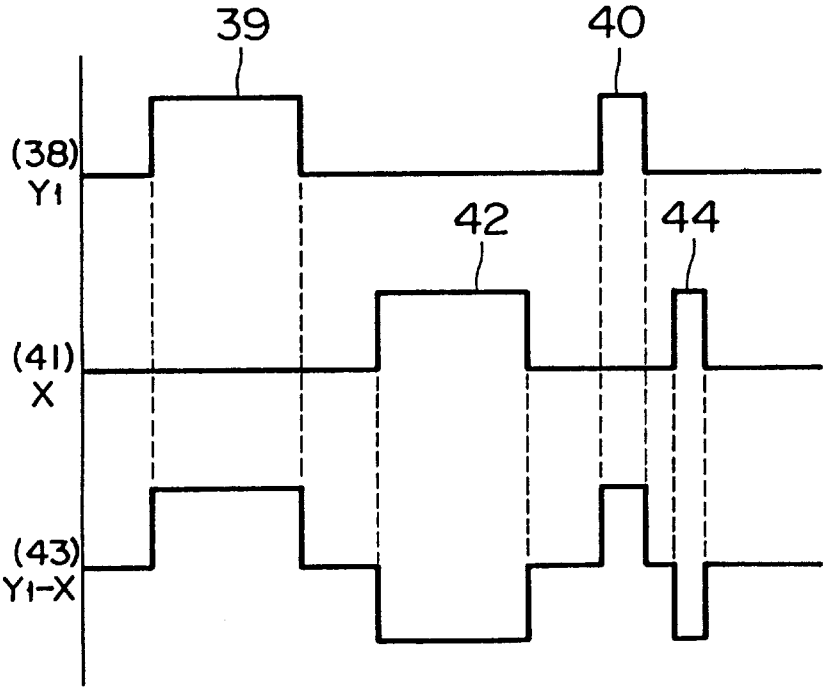
FIG. 11 is a diagram showing voltage waveforms representing the discharge-sustaining and erasing processes.

FIG. 11 shows waveforms in the case where the second short erase pulse 44 is applied to an electrode different from the one to which the first short erase pulse 40 is applied.

In FIG. 11, the interval between the first short erase pulse 40 and the second short erase pulse 44 is smaller than the duration of the first short erase pulse 40. Also, the duration of the second short erase pulse 44 is shorter than the duration of the first short erase pulse 40.

In the waveform 43, the first erasure is performed by the pulse generated upon application of the first short erase pulse 40. Then, the second erasure is accomplished by the pulse generated by applying the second short erase pulse 44. In this way, an even more accurate erasure is assured.

Figure 1:
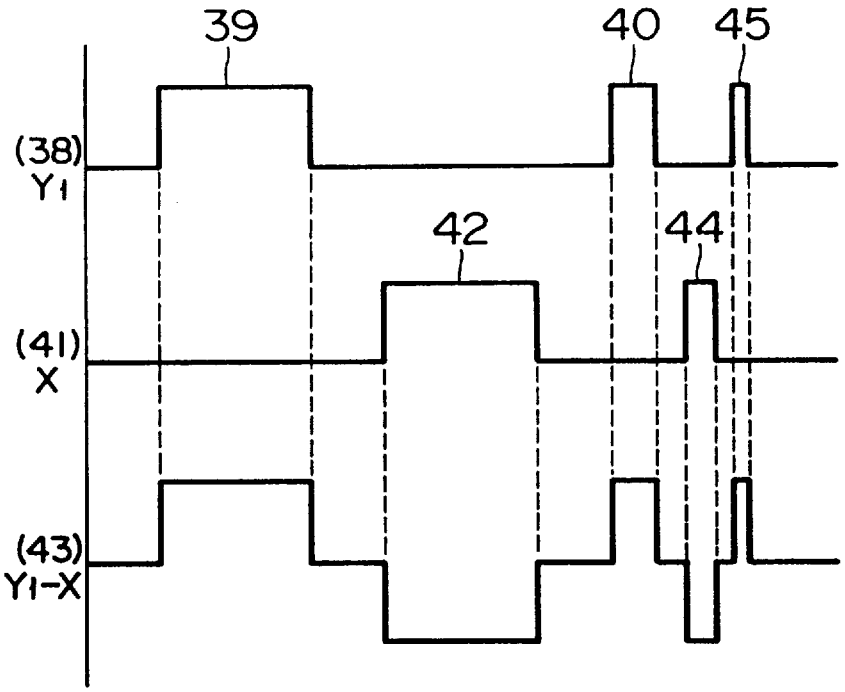
FIG. 1 is a diagram showing waveforms applied during the processes of sustaining discharge and erasure according to the present invention.
Figure 2:
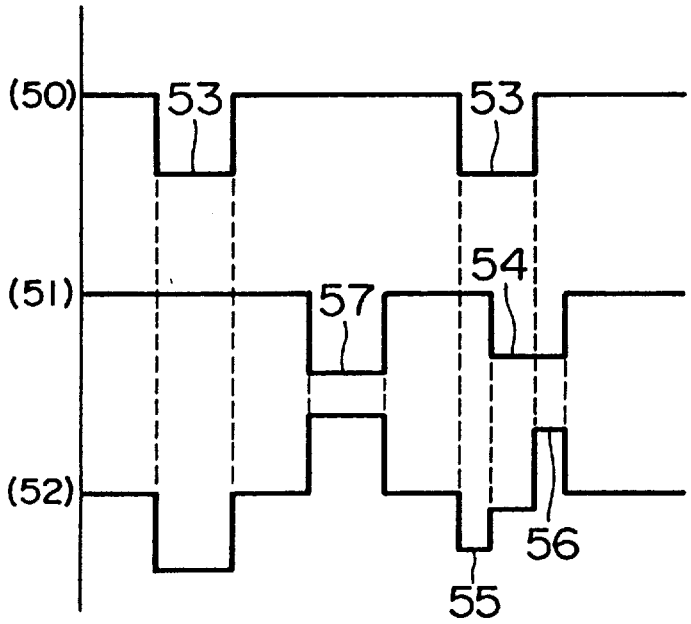
FIG. 2 is a diagram showing waveforms applied during the processes of sustaining discharge and erasure according to the prior art.

FIG. 1 shows waveforms generated when a third short erase pulse 45 is applied to an electrode different from the one impressed with the second short erase pulse 44.

The interval between the second short erase pulse 44 and the third short erase pulse 45 is smaller than the duration of the second short erase pulse 44. Also, the duration of the third short erase pulse 45 is smaller than the duration of the second short erase pulse 44. As a consequence, an even more accurate erasure is accomplished.

As described above, erasure is performed without fail by applying short erase pulses with progressively reduced pulse durations to two electrodes alternately.

Figure 12:
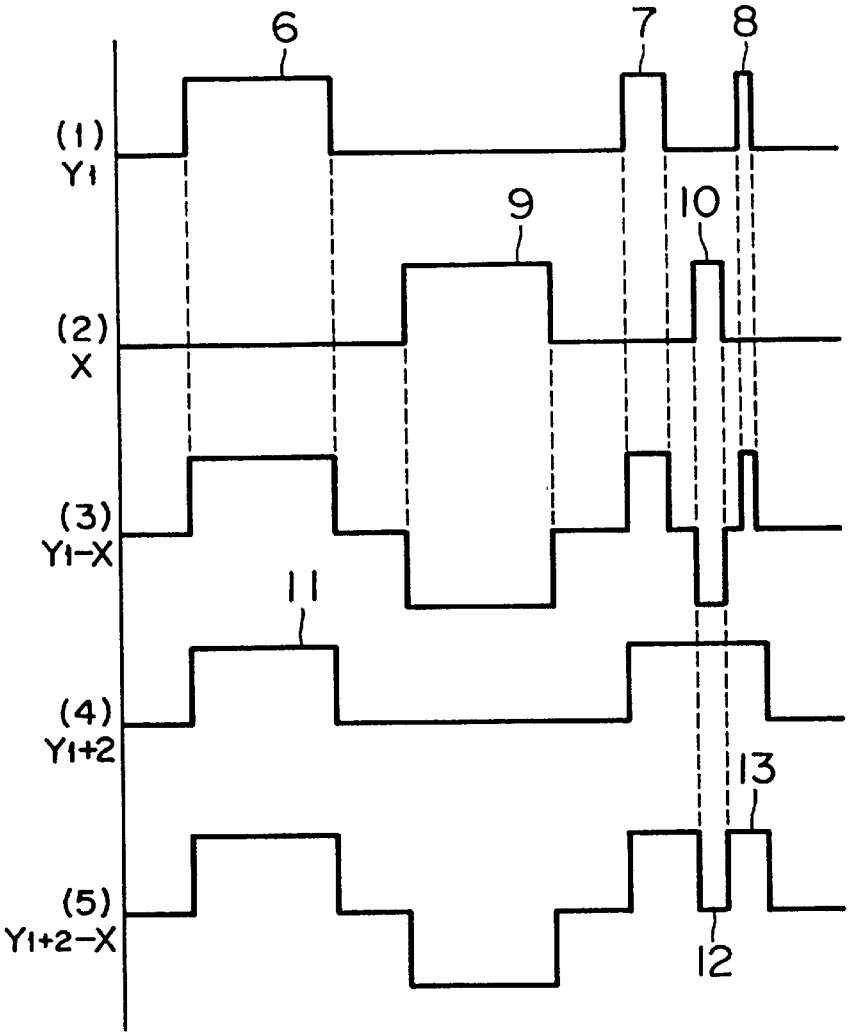
FIG. 12 is a diagram showing waveforms representing the discharge-sustaining and erasing processes.

FIG. 12 shows applied waveforms and waveforms for sustaining discharge in contiguous cells according to the sequential address-display scheme.

In FIG. 12, a waveform 1 represents a voltage waveform of a sustaining pulse 6, a first short erase pulse 7 and a third short erase pulse 8 applied to a Yi electrode among disjoint-line Y2, Y4, . . . , Yn electrodes providing even-numbered line electrodes. A waveform 2 is a voltage waveform of a sustaining pulse 9 and a second short erase pulse 10 applied to joint-line X electrodes providing odd-numbered line electrodes. A waveform 3 is-that of the relative potential difference between two electrodes to be discharged, i.e., a voltage waveform indicating the potential of an disjoint-line Yi electrode less the potential of a joint-line X electrode.

A waveform 4 is a voltage waveform of a sustaining pulse 11 applied to an disjoint-line Yi+2 electrode adjacent to the disjoint-line Yi electrode. Also, a waveform 5 represents a voltage given as the potential of a disjoint-line Yi+2 electrode less the potential of a joint X electrode.

During the erasure period between the joint-line X electrode and the disjoint-line Yi electrode, the discharge is maintained by the sustaining pulses 9 and 11 between the joint-line X electrode and the disjoint-line Yi+2 electrode. Upon application of the second short erase pulse 10 to the joint-line X electrode, the relative potential difference drops to the intermediate potential 12. This potential, however, is restored to a high potential 13 subsequently, thereby continuing the discharge without being erased.

Figure 17:
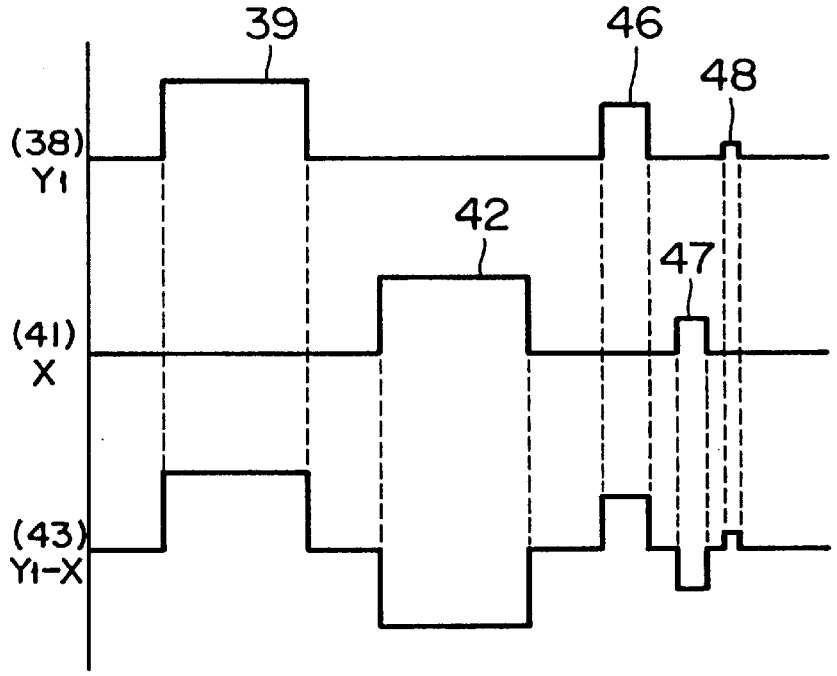
FIG. 17 is a diagram showing voltage waveforms representing the discharge-sustaining and erasing processes.

Although the embodiment under consideration represents a case in which the sustaining pulse 6 has the same potential as the first and third short erase pulses 7 and 8, these potentials can be different from each other. In similar fashion, in spite of the foregoing description about a case in which the sustaining pulse 9 is the same in potential as the second short erase pulse 10, the respective potentials can be different from each other. As shown in FIG. 17, the first short erase pulse 46 is lower in potential than the sustaining pulse 39, the second short erase pulse 47 lower in potential than the first short erase pulse 46, and the third short erase pulse 48 lower in potential than the second short erase pulse 47. This progressive reduction in the potential of the short erase pulses permits an even more effective erasure.

The present embodiment is concerned with the erasure of main discharge performed between the line electrodes of the face plate 15. The discharge performed by the trigger T electrode 23 and the address A electrode 25 on the back plate 22 can also be erased without fail by applying similar short erase pulses.

Figure 19:
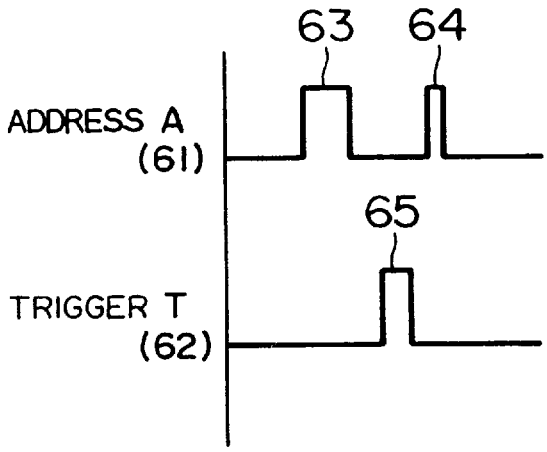
FIG. 19 is a diagram showing charge-erasing waveforms applied to an address A electrode and a trigger T electrode of a back plate.

FIG. 19 shows discharge-erasing waveforms 61, 62 applied to the address A electrode 25 and the trigger T electrode 23 on the back plate 22. For accurate discharge erasure to be performed also on the back plate 22, the first and third short erase pulses 63, 64 are applied to the address A electrode 25, and the second short erase pulse 65 to the trigger T electrode 23. The pulse durations and intervals are progressively reduced. Alternatively, the trigger T electrode 23 may be impressed with the first and third short erase pulses, and the address A electrode 25 with the second short erase pulse.

Figure 13:
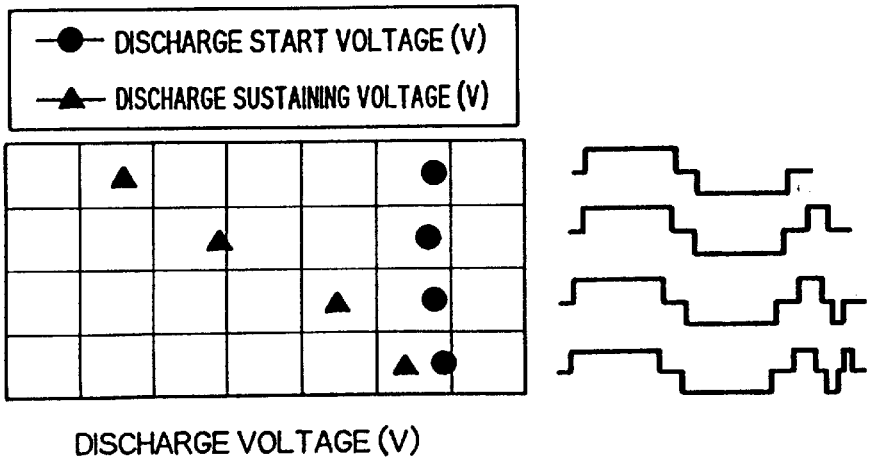
FIG. 13 shows an example measurement indicating the effect of a short erase pulse.

FIG. 13 shows an example measurement of the discharge trigger voltage and the sustaining voltage in the absence of the erase pulse, and with the first to third erase pulses sequentially applied.

In this case, the duration of the sustaining pulse is 4 μsec, the interval between the sustaining pulse and the first short erase pulse is 1 μsec, the duration of the first short erase pulse is 1 μsec, the interval between the first and second short erase pulses is 0.5 μsec, the duration of the second short erase pules is 0.5 μsec, the interval between the second short erase pulse and the third short erase pulse is 0.2 μsec, and the duration of the third short erase pulse is 0.2 μsec. By increasing the number of erase pulses, the discharge sustaining voltage is increased near to a discharge trigger voltage, thereby permitting an erasure without failure.

As described above, accurate erasure is made possible without having an effect on the sustained discharge of adjacent cells within a short period of time.

Now, a second embodiment will be described with reference to FIG. 14.

Figure 14:
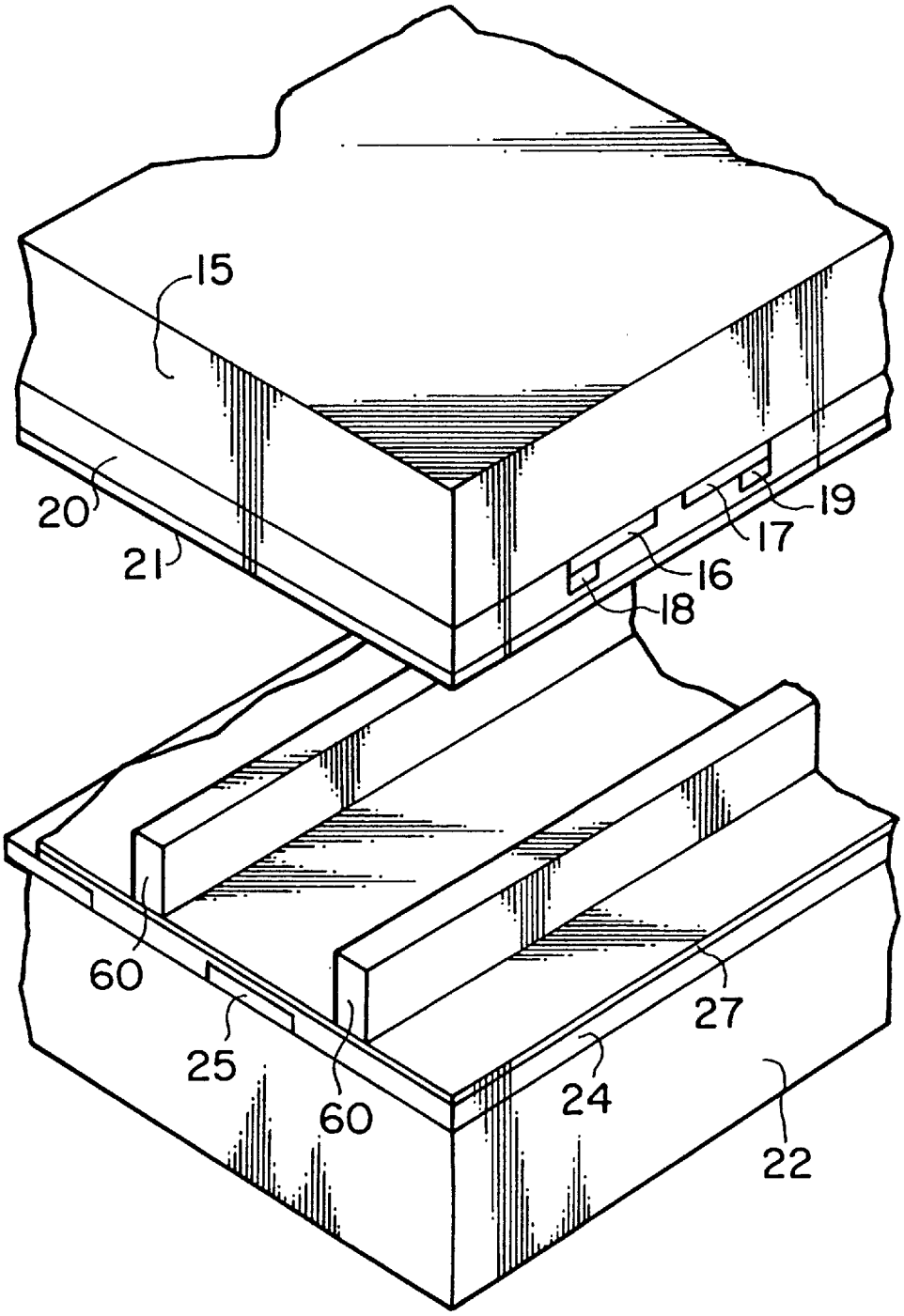
FIG. 14 is an exploded perspective view showing a part of the panel structure according to a second embodiment.

In FIG. 14, barrier ribs 60 are arranged between two address electrodes 25 in parallel thereto. There is no barrier rib unit for separating the face plate 15 and the back plate 22. In this panel configuration, the discharge between the joint-line x electrode 16 and the disjoint-line Y electrode 17 of the face plate 15 can be erased without fail also by applying similar short erase pulses.

Also, erasure of discharge can also be assured between the address A electrode 25 and the disjoint-line Y electrode 17 on the back plate 22 by applying similar short erase pulses.

Figure 20:
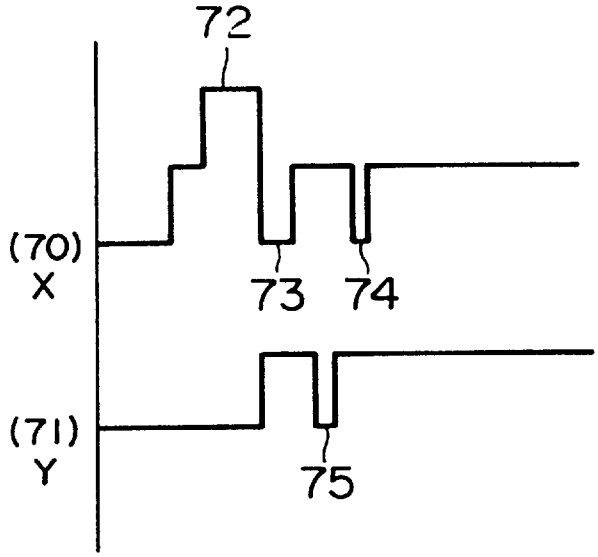
FIG. 20 shows an example driving scheme during the full write and erasure period for subfields in the panel structure of FIG. 14.

FIG. 20 shows an example driving scheme applied to the full write and erasure period of an arbitrary subfield in the configuration shown in FIG. 14. A waveform 70 is that of a voltage applied to the joint-line X electrode 16, and a waveform 71 that of a voltage applied to the disjoint-line Y electrode 17. The waveform 70 contains first and third short erase pulses 73, 74 and a full write pulse 72 for initiating discharge over the entire screen, and the waveform 71 incorporates the second short erase pulse 75. The pulse durations and intervals are progressively reduced.

Figure 21:
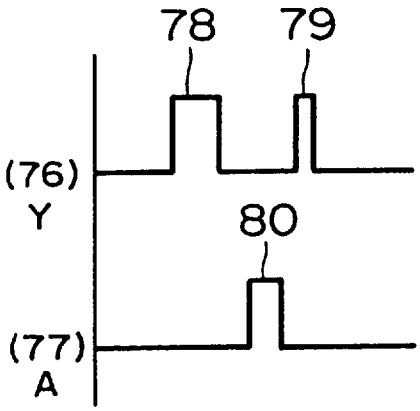
FIG. 21 is a diagram showing charge-erasing waveforms applied to the disjoint-line Y electrode on the face plate and the address A electrode on the back plate.

FIG. 21 shows charge-erasing waveforms 76, 77 applied to the disjoint-line Y electrode 17 on the face plate 15 and the address A electrode 25 on the back plate 22. If discharge is to be accomplished without fail on the face plate 15 and the back plate 22, the first and third short erase pulses 78, 79 are applied to the disjoint-line Y electrode 17, and the second short erase pulse 80 to the address A electrode 25. The pulse durations and intervals are progressively reduced. Alternatively, the first and third short erase pulses can be applied to the address A electrode 25, and the second short erase pulse to the disjoint-line Y electrode 17.

We claim:

1. A plasma display apparatus comprising:

a plurality of pixels arranged in dot matrix;

at least one first electrode for specifying light emissions of said pixels;

a set of electrodes including second and third electrodes arranged in said pixels for generating a discharge to display a pixel; and a phosphor material arranged in said pixels and illuminated by ultraviolet rays generated from said discharge;

wherein charges sustaining said discharge are erased by applying a first erase pulse with a pulse duration equal to or smaller than about 1.5 μsec. and a plurality of erase pulses with progressively shorter pulse durations than that of said first erase pulse and alternately applying the erase pulses to two selected electrodes other than the first electrode, the second electrode and the third electrode, and respective intervals between said plurality of erase pulses become progressively shorter when said plurality of erase pulses is more than two.

2. A plasma display apparatus according to claim 1, wherein potentials of said erase pulses applied to said second electrode, immediately after discharge sustaining pulses are applied to said second electrode and said third electrode, are progressively reduced from a potential of said discharge sustaining pulses.

3. A dot matrix AC plasma display apparatus of a memory type according to a separated address-display scheme, comprising a set of at least two electrodes for sustaining discharge and erasing charge, wherein a first charge-erasing pulse with a pulse duration equal to or smaller than about 1.5 μsec. and a plurality of charge-erasing pulses with progressively shorter pulse durations than that of said first charge-erasing pulse are applied alternately to two electrodes during the process of erasure, and respective intervals between said plurality of charge-erasing pulses are progressively shorter when said plurality of charge-erasing pulses is more than two.

4. An AC plasma display apparatus according to a claim 3, wherein the first charge-erasing pulse with a pulse duration equal to or smaller than about 1.5 μsec. and the plurality of charge-erasing pulses with progressively shorter pulse durations are applied alternately between the two electrodes a plurality of times, and respective intervals between the plurality of charge-erasing pulses are progressively shorter if a number of said plurality of charge-erasing pulses is more than two.

5. An AC plasma display apparatus according to claim 3, wherein potentials of the charge-erasing pulses are progressively reduced from a potential of said discharge sustaining pulses, immediately after a sustaining discharge.

6. An AC plasma display apparatus according to claim 3, wherein the two electrodes for erasing charge by applying a plurality of charge-erasing pulses include an address electrode on the back plate and a disjoint electrode on the face plate.

7. A method for driving a dot-matrix AC plasma display apparatus of a memory type comprising a plurality of disjoint electrodes and a plurality of joint electrodes in parallel to the disjoint electrodes according to a sequential address-display scheme, comprising the steps of:

applying a first charge-erasing pulse and subsequently a plurality of subsequent charge-erasing pulses;

wherein odd numbered charge-erasing pulses are applied to the joint electrodes and even numbered charge-erasing pulses are applied to the disjoint electrodes; and locating said charge-erasing pulses at positions corresponding to the pulse period of a sustaining pulse applied to the disjoint electrodes corresponding to contiguous pixels.

8. A method for driving a plasma display apparatus according to claim 7, wherein said first charge-erasing pulse has a duration equal to or smaller than about 1.5 μsec. and said plurality of charge-erasing pulses having progressively shorter pulse durations than the first charge-erasing pulse are applied alternately between two electrodes a plurality of times, and respective intervals between said first charge-erasing pulse and said plurality of charge-erasing pulses are progressively shorter if a number of said plurality of charge-erasing pulses is more than two.

9. A method for driving a plasma display apparatus according to claim 7, wherein potentials of the charge-erasing pulses are progressively reduced from a potential of discharge-sustaining pulses.

10. A method for driving a plasma display apparatus according to claim 7, wherein two charge-erasing electrodes supplied with said first charge-erasing pulse and said plurality of charge-erasing pulses include an address electrode on a back plate and a disjoint electrode on a face plate.

* * * * *